US005121685A

United States Patent [19]

Turner

[11] Patent Number: 5,121,685

[45] Date of Patent: Jun. 16, 1992

[54] CAN CRUSHER

[76] Inventor: John Turner, 1288 N. Bagley, #136, Dallas, Tex. 75211

[21] Appl. No.: 614,249

[22] Filed: Nov. 15, 1990

[51] Int. Cl.[5] ..... B30B 1/04; B30B 9/32

[52] U.S. Cl. ..... 100/49; 100/902; 100/292; 100/216; 100/137; 100/53

[58] Field of Search ..... 100/45, 49, 53, 902, 100/137, 215, 216, 282, 291, 292

[56] References Cited

U.S. PATENT DOCUMENTS

| | | | |
|---|---|---|---|
| 2,958,273 | 11/1960 | Morrow | 100/98 |
| 3,667,386 | 6/1972 | Workman | 100/233 |
| 3,832,941 | 9/1974 | Moller | 100/902 |
| 3,842,731 | 10/1974 | Anderson | 100/291 |
| 3,988,978 | 11/1976 | Flick | 100/35 |
| 4,291,618 | 9/1981 | Heiser et al. | 100/902 |
| 4,292,891 | 10/1981 | Shelley | 100/193 |
| 4,358,994 | 11/1982 | Talley | 100/49 |
| 4,653,398 | 3/1987 | Fowler | 100/233 |
| 4,916,932 | 4/1990 | Obrecht et al. | 100/281 |

*Primary Examiner*—Timothy F. Simone
*Assistant Examiner*—Reginald L. Alexander
*Attorney, Agent, or Firm*—Hubbard, Thurman, Tucker & Harris

[57] ABSTRACT

A can crusher apparatus is presented for crushing aluminum cans into a crushed relationship wherein the upper and lower circular end faces are generally unaltered and aligned in a co-planar position, the crushed pattern accomplished by the result of placing the can in a perpendicular position to an elongated rectangular crushing plate for creasing a center portion followed by moving a ram plate and can into contact with a vertical wall. The crushing motions of the crusher are achieved through dual cam and slot means cooperatively drivably connected to a force transfer block which imparts a predetermined relation translation motion of the plates in response to rotation of the transfer block.

10 Claims, 3 Drawing Sheets

CAN CRUSHER

BACKGROUND OF THE INVENTION

The use of aluminum and other metal cans has greatly increased within the last twenty years particularly in the field of canned soft drinks and beer. The employment of aluminum in the manufacture of these cans has met with considerable success and the employment of aluminum in the manufacture of the cans instead of other metals has enabled the manufacturer of cans to provide an easy opening tab at one end thereof which may be easily manipulated to form an opening in the can. Also, for shipping purposes, all aluminum cans are much lighter than the previous can's construction of sheet steel or sheet metal. The employment of aluminum in the manufacture of cans has increased the cost of manufacture due to the higher cost of aluminum as compared to the prior materials of construction. Therefore, recycling of empty cans is an established element of commerce which not only benefits society in removing cans from highways and byways but provides free enterprise funding for recycle, thus collection and reuse disposal.

Numerous devices have been provided in the past to crush empty cans that previously held beverages, fruits or vegetables, motor oil and the like. Historically, the focus has been on crushing the can in the most efficient way possible in terms of cost and efforts so that the remanents take up less space in a garbage bag or a box until the cans are disposed of permanently, generally in a landfill. However, in recent years widespread concern about the environment has led to the enactment of popularly called "bottle bills" which require manufacturers of soft drinks and beer to charge a deposit on cans as well as other beverage containers such as bottles, so as to encourage the purchasers to return the empty containers to the store rather than discard these containers at the expense of the environment. Parallel to this method of encouraging recycle of cans, recycling centers have become a part of every day life in almost every community wherein aluminum cans may be sold. Unfortunately, recycled aluminum cans are very light and bulky for collectors and recyclers. A need exists for apparatus and methods by which the aluminum can may be crushed for collection, handling, return storage and shipping recycle purposes.

A small economic emphasis created by reimbursement of a deposit charge as well as cash paid per pound for recycled aluminum at the recycle centers encourages the population in general to avoid litter and the separation of aluminum can from other waste materials which eventually wind up in solid waste disposal systems inclusive of landfills. Both the recycle and return for deposit methods assist in the preservation of natural resources by encouraging manufacturers of beverage containers to reuse the containers or recycle the materials of which the containers are made. In fact the beverage containers, specifically aluminum beverage containers, which have been frequently and continue to be thoughtlessly discarded in public places will be collected by individuals to whom the recycle purchases are sufficient to encourage these individuals to collect aluminum cans from public places inclusive of the streets, highways and parks.

The so-called bottle bills have caused a number of storage and transportation problems for example, empty cans take up an unreasonable amount of space in handling and shipping. The expanded space requirements of storage and handling of these cans creates inconveniences and substantial overhead expenses which in many cases nullify the recycle value. Unlike bottles which may be sterilized and refilled, empty cans must eventually be crushed and their component materials recycled. It is desirable, since cans are safer, more compact, lighter and easier to store when crushed, to further encourage the use of cans by providing devices and methods for home, restaurant, bar and other commercial uses which can fold and crush these empty cans so that their density takes up a fraction of their previous space. Merely crushing the cans, however, in a conventional fashion simply will not suffice. Most states currently have no statutory deposit requirements and yet the bottlers use essentially the same designs on their cans across state lines. To avoid fraud, therefore, the cans must be identifiable as deposit cans. Furthermore, the trademark on the side of the can must be identifiable so that the can will be returned to the proper supplier. Once cans have been crushed by various prior art crushing devices which flatten the cans in a plane through the longitudinal axis, the written material on the sides of the cans are unreadable. In other aspects the faces, i.e., the circular end face of the can, generally contain the deposit information on the upper face. Most can crushing operations squeeze the two end faces of the can toward each other. This is just as unsatisfactory for purposes of the bottle bill concept because, after the operation is complete, the cylindrical wall is entirely obscured and thus identification of the trademark or the name of the manufacturer or bottler is impossible.

Other devices provide crushed cans wherein all the relevant printed matter is identifiable. In these crushers, the can is creased at the center of the cylindrical wall either prior to or during the crushing operation. However, in most of the embodiments disclosed, two separate manual operations are required, the first to crease the can and the second to complete the fold of the can. In other embodiments the creasing element is never fully retracted during the crushing operation and thus the printed matter on the end faces of the can is partly obstructed.

Several references exist which describe apparatus for laterally crushing cans as opposed to crushing in an end to end matter. In this regard U.S. Pat. No. 3,832,941, issued to Bynumw Moller and U.S. Pat. No. 4,291,618, issued to Warren R. Heiser et al. present apparatus and methodology for crushing cans by first laterally compressing the central portion of the can to inwardly tilt the can's opposite ends, and then further flattening the can by further tilting the can ends until they lie in generally the same plane and parallel to the flattened can body. In this regard the can crushing sequence of the Moller reference provides a center crushing element which is pushed through a slot in a stationary plate to laterally flatten the center portion of the can against a movable plate. The crushing element is then withdrawn and the movable plate is moved to flatten the can against the stationary plate. The flattened can is then dropped through a slot thus removing the can from the apparatus.

A similar crushing sequence is presented in the Heiser et al. reference wherein a plunger is moved forward through a slot in a movable plate to crush a central portion of a can. The plunger is then withdrawn and the movable plate is moved to complete the lateral crushing of the can which is then dropped through an opening.

A need still remains for improved can crushing apparatus for use in the home, commercial establishments and the like. Such a need can be further filled by an apparatus which has fully automation capability for crushing cans, along with safety limitations and yet which provides a crusher wherein the moving plates define motion which is unilateral. Apparatus which avoids moving the plates in opposing directions at the same time provides a more smoothly operating longer life apparatus. In another aspect apparatus is needed which can provide can crushing using minimum power and sizing for general home use. Thus, one of many objects of the invention is to provide a can crusher which may be of simple construction and easy to use so as to provide an apparatus that will be economically feasible, longlasting and relatively trouble free in operation.

SUMMARY OF THE INVENTION

The can crusher apparatus of the present invention crushes cylindrical cans such that the upper and lower circular end faces of the crushed can are generally unaltered and aligned in a co-planer relationship. This crushed pattern is accomplished by the apparatus as a result of presenting the can in a perpendicular position to an elongated rectangular crushing plate for creasing or crushing a center portion of the can followed by moving a ram plate and the can into contact with a vertical wall through operation of the can crusher which is suitable for laterally crushing aluminum cans. The can crusher may be conveniently secured to the underside of a cabinet or in a large trash can environment wherein the crushed cans are dropped through a can drop space into the receptacle.

The apparatus provides a dual plate drive system and associated cam slot means driven by a drive member wherein cooperative cam and slot configuration in the respective overlapping plate means operate in such a manner as to impart predetermined relation translation motion to the plates in response to rotation of the drive member and cam means. The predetermined relation translation motion of the plates in response to the defined cam means provides crushing motion variations which allows maximum crushing power toward the end of the crush cycle by slowing the movement of the crushing plates. The can crusher is automated with a pivotally mounted support base within a crushing chamber which acts as a switch means for activating the crusher when a can is placed in the chamber thus activating the pivotally mounted switch means through the action of the can's weight on the support base. The can crusher according to the invention is operated through power driven means and while being fully automated in one embodiment to safely crush one can at a time, may be provided with various feed means in accordance with the invention to provide multiple can feed to the apparatus wherein one can at a time is crushed.

The many objects and advantages of the present invention will become apparent to those skilled in the art when the following description of the invention and its various embodiments are reviewed in accompaniment with the attached drawings wherein like reference numerals refer to like components throughout.

BRIEF DESCRIPTION OF THE DRAWINGS

FIG. 4 presents the elongated rectangular crushing plate extended out into the can's central portion as indicated by arrows. FIG. 5 illustrates the ram plate moving the precreased can toward a vertical front wall for crushing while the crushing plate is being withdrawn as indicated by arrows. FIG. 6 further illustrates the crushing plate moving through the crush cycle for maximum crush position between the two plates.

DETAILED DESCRIPTION OF THE INVENTION

Figure 1:
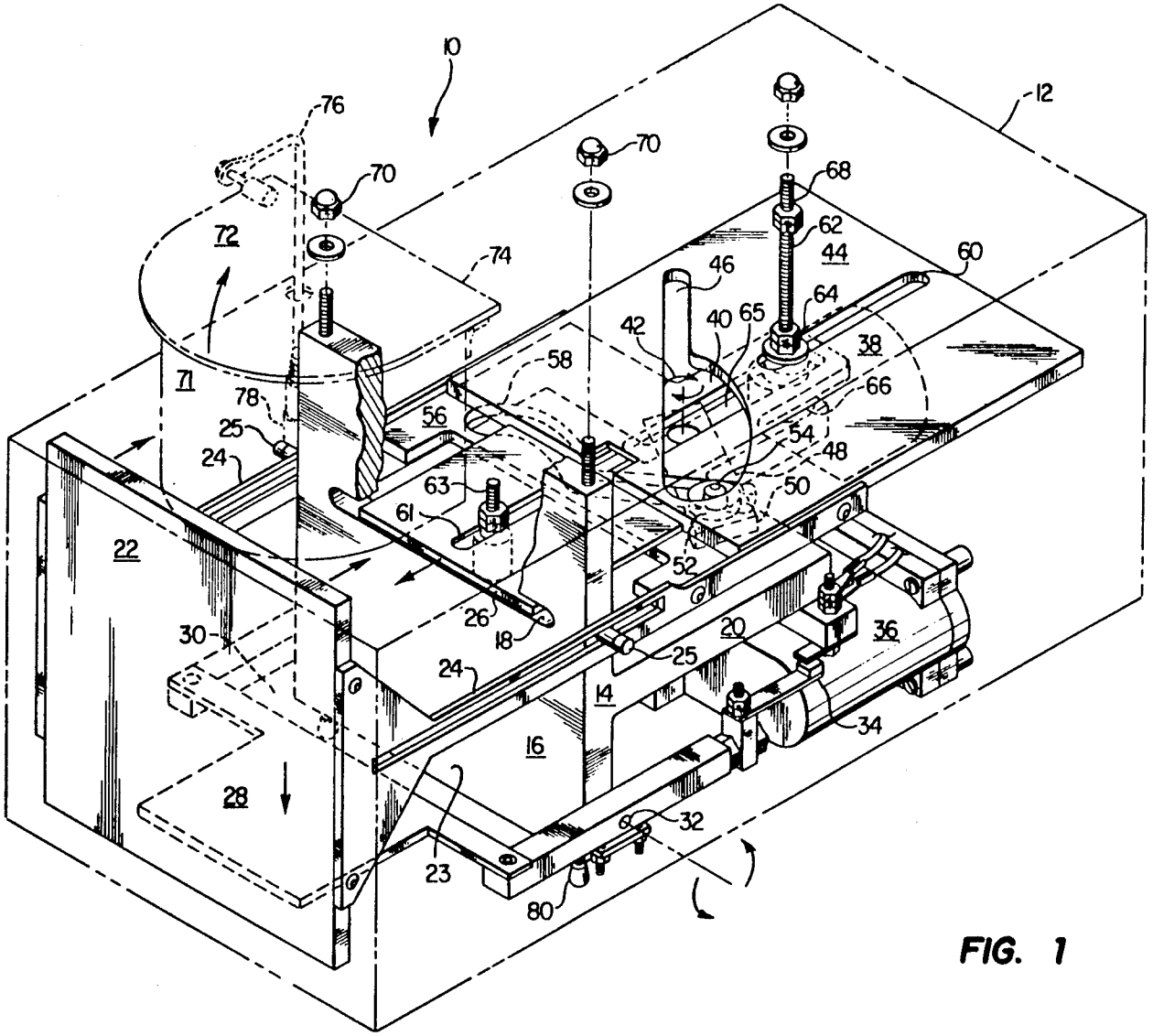
FIG. 1 is a partially cutaway perspective view of the embodiments of the mechanized and automated can crusher according to the invention. Movement of the relative elements including the dual drive plate system of the apparatus are shown by arrows.

The present invention relates to an apparatus for crushing cans which, as can be seen by the figures, contemplates the use of automatic power driven self contained can folding and crushing apparatus 10 such as may be used in a retail outlet, restaurant, bar or home. The partially cutaway perspective view of the embodiments of the automated and mechanized can crusher as presented in FIG. 1 presents the can crusher 10 with a housing 12. The basic structural support of the can crusher 10 is the T-shaped support structure 14. The T-shaped support structure 14 presents a vertical front wall 16 which is utilized as a fixed and stationary or anvil type crushing wall. The vertical front wall 16 has a rectangular slot 18 therethrough which accommodates entry and withdrawal of the crushing plate 26 which accommodates entry and withdrawal of the crushing plate 26 into and from the crushing chamber 23. A ram plate 22 is drawn against the vertical front wall 16 after the crushing plate 26 has been withdrawn. The T-shaped support structure 14 has a horizontal portion 20 which provides the T-shape of the support structure 14 in cooperation with the vertical front wall 16. In addition, the horizontal portion 20 provides structural mounting support for the various components of the dual plate, cam means and drive means. Slotted horizontal support arms 24 in cooperation with fixed guide pins 25 support the ram plate 22 and provide directed motion means of the ram plate 22 through the actions of an elongated rectangular horizontal drive plate 56 which is in structural communication with the ram plate 22 through the slotted support arms 24.

When a can is placed into the crushing chamber 23 the weight of the can rests on the U-shaped platform 28 activating the U-shaped platform pivot 32 which in turn moves the U-shaped platform switch means 34 into an activation mode for activating the crushing cycle of the apparatus. A gear box 36 provides drive means 40 through clockwise rotation of a vertical shaft to a crushing plate drive portion 44 through a drive force transfer block 48. The drive means 40 is driven by an electrical motor which is present in phantom and which is activated by the U-shaped platform switch means 34. The drive force transfer block 48 is driven in clockwise rotation as indicated by the clockwise rotation arrows 42 on the drive means 40, the drive force transfer block 48 being mounted on the drive means 40. The drive force transfer block drive end 50 provides a cam motion drive to the drive slot 46 of the crushing plate drive portion 44. The drive force transfer block 48 has a first cam drive means 52 mounted on the transfer block drive end 50 and a second drive means 54 eccentrically mounted on the first cam drive means 52. The second drive means 54 functions in cooperation with a cam drive slot 58 in the horizontal drive plate 56; thus providing part of a dual plate drive system and associated drive cam means. As the ram plate 22 is driven to maximum crush contact with the can the drive means 52 and drive slot 58 cooperate to slow the ram plate 22 forward crushing motion with motor output remaining at maximum thus providing greater torque. Such design permits use of a smaller power source by maximizing crushing power at the end portion of the crush stroke. The second drive means 54 functions in cooperation with the drive slot 46 in the plate 44; thus providing the remaining cam slot drive for the dual plate drive system. The crushing plate drive portion 44 has a travel guide slot 60 and the crushing plate 26 has a travel guide slot 61 which maintains the respective portions of the travel plate in alignment during motion. Guide rod and support means 62 functions in cooperation with the rear crushing plate travel guide slot 60 and guide rod and support means 63 cooperate with the front crushing plate travel guide slot 61 maintaining the crushing plate in a substantially fixed horizontal position at all points of motion. The respective guide rod and support means 62 and 63 further support the apparatus in relationship to the T-shaped support structure 14. In addition, the guide and support rod 62 provides housing support through member 68. A parallel and superimposed drive plate guide slot 65 in the elongated rectangular horizontal ram plate drive plate 56 is provided which also utilizes the guide and support rod 62. A ram plate drive support contacting spacer 66 through which support guide rod 62 extends provides crushing and ram plate support through the T-shaped support structure 14.

Additional T-shaped housing support members 70 provide housing 12 support to the vertical portion of the T-shaped structure 14, the housing support members 70 being in communication with the top portions of the vertical front wall 16.

The apparatus is provided with a feed can chute 71 having a lid 72. The lid 72 has a pivot means 74 and a lid arm means 76 which upon opening of lid 72 activates a electric circuit switch means 78 which places the apparatus according to the invention in an operational mode and upon introduction of a can into the crushing chamber 23 resulting in the activation of the U-shaped platform switch means 34 automatically starts the can crushing cycle.

The housing and structural components of the can crusher are further supported, for example, by can crusher 10 support legs 80, lower wall edges of the housing and additional motor and gear box support legs (not shown). The pivotally mounted U-shaped platform and associated switch means 34 in cooperation with lid 72 switch means 78 provide an automatic mechanized can crusher with built-in safety features wherein a dual plate drive system in association with drive cam means provide the functional steps of creasing and then crushing aluminum cans into the configuration with the cylindrical ends of a crushed can are in planer alignment.

The can crusher 10 of the present invention is utilized to laterally crush aluminum cans to a flattened configuration for recycling purposes. The can crusher 10 may be conveniently secured in various work locations as demanded by commercial or home use. The can crusher 10 includes a generally T-shaped support structure 14 having a vertical front wall 16 with an elongated rectangular slot 18 formed therethrough above a horizontal portion 20 of the support structure. The ram plate 22 is carried toward the parallel front wall 16 by slotted support arms 24 connected at their rear ends to a drive plate 56 which is driven by the cooperation of a cam and slot means by a drive force transfer block 48 as indicated by motion arrows in FIG. 1. The elongated rectangular ram plate 22 is carried on the support structure 14 for forward and rearward movement relative thereto, as indicated by the arrows in FIG. 1 and is moveable forwardly and rearwardly through the elongated rectangular slot 18.

The can crusher 10 also includes a generally U-shaped platform 28 which is pivotally secured to a lower end of the support structure 14 and defines a can drop space 30 therewith. To drive the ram plate 22 and the crushing plate 26 forwardly and rearwardly in a sequence subsequently described, the can crusher 10 is provided with an electrical motor 38 connected to a gear box 36. The gear box 36 is drivenly connected to a cam means operatively received in cam slots 58 and 46 through the dual plate system and the drive force transfer block 48.

Figure 2A:
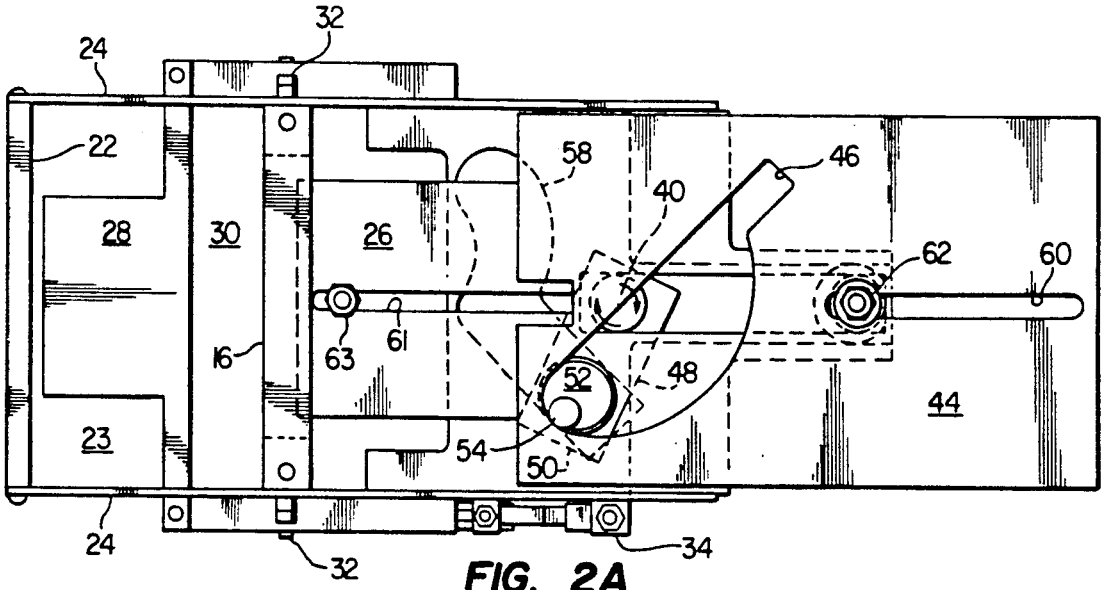
FIG. 2A is a top view of selected elements of the can crusher with the dual drive plate system and associated drive cam means in a relaxed position or starting position with the drive shaft rotation illustrated by arrows.
Figure 2B:
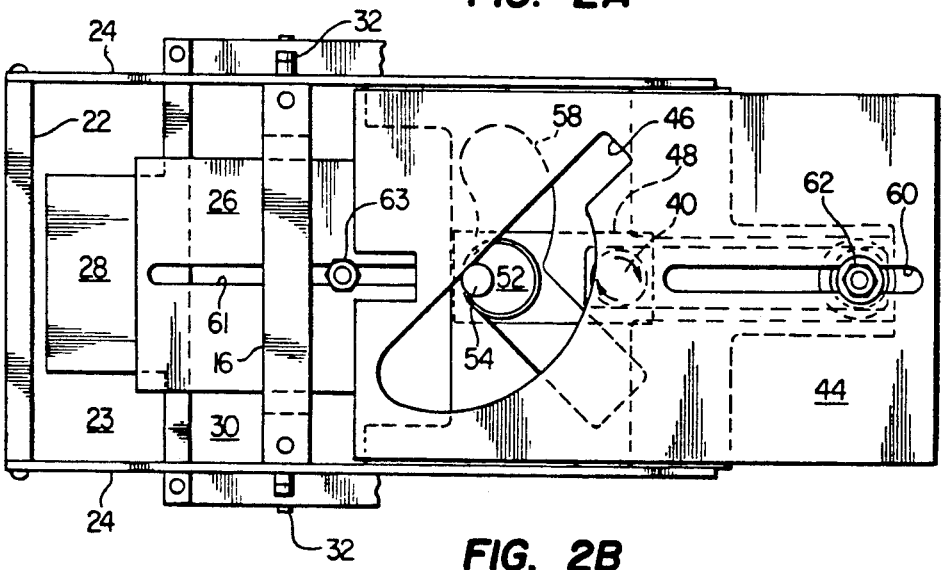
FIG. 2B is a top view of the dual plate drive system and associated drive cam means with the apparatus positioned about twenty-five percent through the crushing cycle.
Figure 2C:
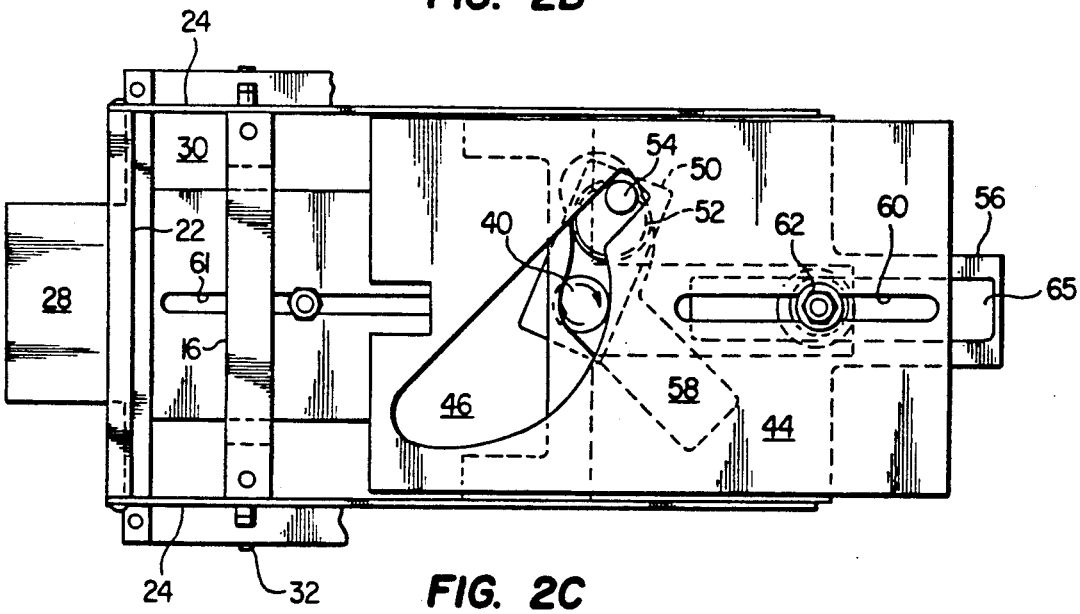
FIG. 2C is a top view of the dual plate drive system and associated drive cam means with the drive shaft rotation illustrated by arrows, rotating in a clockwise continuous fashion positioning the apparatus in a total crushing position with the continuous mode of the apparatus passing through the crushing cycle with the dual plate drive system moving away from the crushed position.
Figure 3:
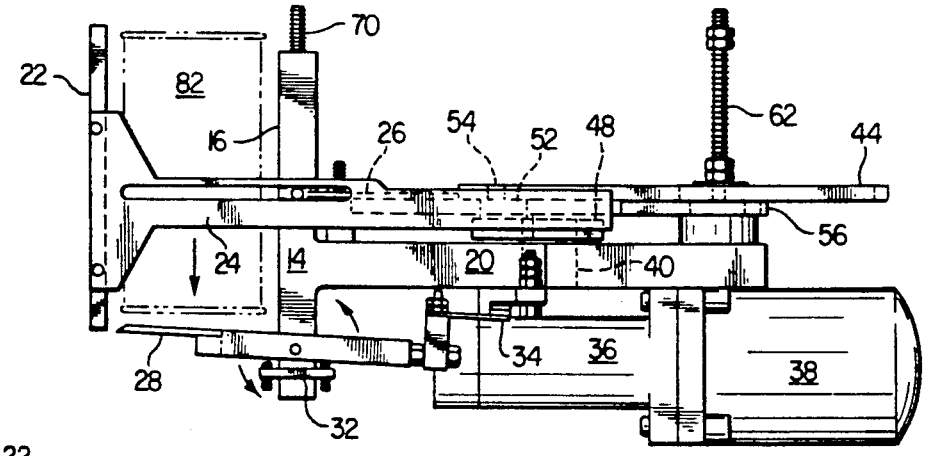
FIG. 3 is a side view of the unit according to the invention with a can in place for crushing and with the pivotal gate and switch means respective motions indicated by arrows similar to those of FIG. 1.
Figure 4:
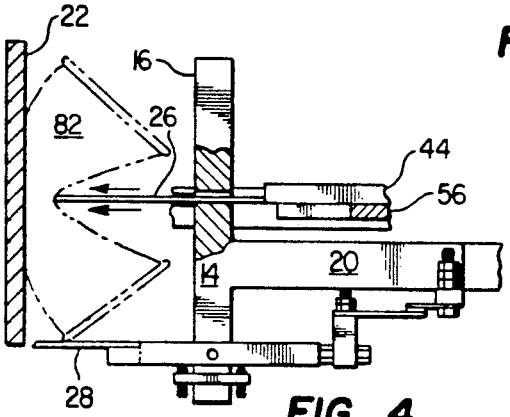
FIGS. 4, 5 and 6 are schematics of the can crushing positions of the apparatus with respective dual plate movement cycles.

The sequence of operation of the can crusher 10 is illustrated through FIGS. 2A, 2B, 2C and 3 through 7. With the can crusher 10 in its ready to use position, FIGS. 2A and FIG. 3, an aluminum can is dropped into place between the vertical front wall 16 and ram plate 22 which defines the crushing chamber 23. The positioning of the can is such that the bottom end of the can comes to rest upon the U-shaped platform 28 with the weight of the can pivoting the U-shaped platform 28 in a counterclockwise direction as indicated thereby closing switch means 34 and energizing the motor 38 to rotate the cam and slot means drive force transfer block 48. Initial rotation of the drive block 48 drives the crushing plate 26 forwardly through the rectangular slot 18 and the vertical front wall 16 to thereby cause the end of the crushing plate to engage a central portion of the can and crush it against the momentarily stationary ram plate 22 as depicted in FIG. 4 and in FIG. 2B (can not shown).

Continuous rotation of the cooperative cam and slot means as driven by the drive force transfer block 48 thereby imparting a predetermined relational translation motion to the plates simultaneously moves the crushing plate 26 and the ram plate 22 in a unilateral direction to bring the partially creased or bent-over can ends into contact with the front wall 16. Continued movement toward the front wall 16 of the crushing plate 26 and the ram plate 22 withdraws the crusher plate 26 through the rectangular slot 18 in the front wall 16 and causing the ram plate 22 to laterally crush the can to its flattened orientation in which the can body is laterally flattened and the can ends have been rotated 90% relative to their normal orientation. Finally, continued rotation of the cam and slot means drives the ram plate 22 toward its starting orientation thereby releasing the laterally flattened can previously held between the ram plate 22 and the front wall 16 thus permitting the can to fall through the can drop space 30 of the U-shaped platform 28 into a trash receiver or container for storage.

FIGS. 2A, 2B and 2C provide a top view of the dual plate, associated cam and slot means as well as the drive member means in respective positions during the crushing cycle. In FIG. 2A the apparatus is at rest position while in FIG. 2B the apparatus has progressed to an approximate 25% cycle position as can be seen by the movement of crushing plate drive portion 44 and the drive portion 44 cam drive slot 46 as well as the movement between FIG. 2A and FIG. 2B of the drive force transfer block 48 which in FIG. 2B is extended to its maximum length toward the can crushing chamber. The cam means in FIG. 2B have also traveled from one end of the cam drive slot 58 in plate 56 to a mid-portion of the slot 58 as shown in FIG. 2B. The cam drive means is positioned in both slot means in the opposite end portions of the slot means in FIG. 2C during the maximum crush cycle, from the position of FIG. 2A which is the apparatus at rest. In addition, FIGS. 2A, 2B and 2C further illustrate the dual plate respective motions from rest to 25% cycle to 50% cycle just before the return to rest cycle.

Figure 5:
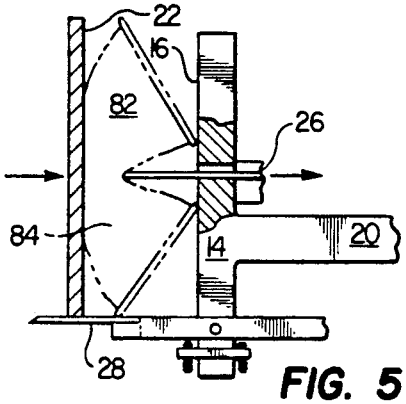
Figure 6:
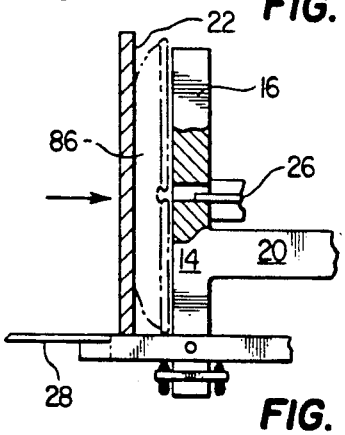
Figure 7:
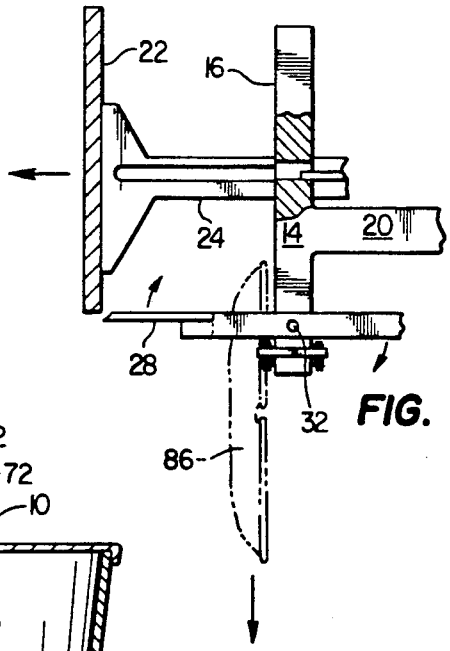
FIG. 7 illustrates the return of the crush chamber elements of the apparatus to a relaxed position while indicating the pathway of drop or removal of the crushed can from the apparatus.
Figure 8:
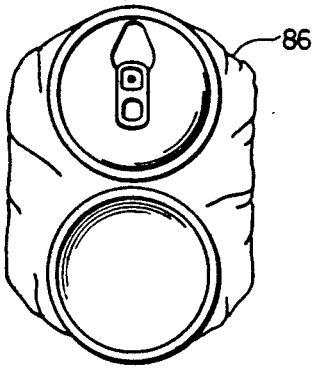
FIG. 8 presents a plane view of the can after being crushed by the apparatus according to the invention.
Figure 9:
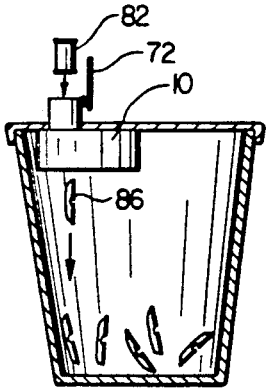
FIG. 9 is a simplistic schematic of the can crusher mounted on a receiving container for receiving and storing the crushed cans.

In FIGS. 3-7 various cutaway side views are shown focusing primarily on the can crushing chamber 23. In FIG. 3 a side view of the can crushing chamber 23 is shown with a can being placed in position for crushing and the respective motion of the can, through its weight action on U-shaped platform 28, U-shaped platform pivot 32 and switch means 34. FIG. 3 shows the respective dual plate cam slot means in the at rest position just before activation by the actions of switch means 34. FIG. 4 shows the apparatus during one portion of the cycle wherein the crushing plate 26 is extending into the can to approximate maximum extended position. In FIG. 5 the crushing plate 26 is in a withdrawing mode as indicated by the arrow while the ram plate 22 is being moved toward the front wall 16 thus forcing the partially crushed can 84 with its cylindrical end portions tipped by about 90% toward the vertical for final crushing. FIG. 6 shows the ram plate 22 in the maximum crushing position as indicated by the arrow where the ram plate 22 has moved to its closest proximity to the front wall 16. The can as shown in FIG. 6 has been crushed to its minimum dimension by the apparatus. In FIG. 7 the apparatus has moved toward the end of the full cycle wherein the ram plate 22 is moving to its at rest position as indicated by the arrow, the U-shaped platform 28 is returning to its at rest position thus through pivot arm means is moving toward a switch means disconnect while the maximum crushed can is falling through the can drop space 30. The crushed can configuration is illustrated in FIG. 8 while in FIG. 9 a simplistic schematic of the can crusher mounted on a receiving container for the crushed cans is shown with a can 82 in position to be received by the can crusher through open lid 72 and with a crushed can 86 being released into the receiving container.

In other embodiments not shown by the drawings, the apparatus according to the invention can be fitted with a can feed chute for supplying the cans one at a time into the crushing compartment, for example, a gravity fed chute to the crushing compartment. A feed tube could be added to the apparatus wherein about one half dozen cans at one time could be loaded for crushing. The tube (not shown) would be mounted on a compound angle so that a can waiting would ride smoothly over the top of the can being folded and the crush plate. In addition, as is shown in the drawings, a disposal receiver can be positioned with the apparatus according to the invention or a disposal chute can be positioned with the can crusher apparatus which is not shown. The disposal chute would drop the crushed cans into a slightly removed receptacle.

The apparatus according to the invention incorporates a number of features of a safety nature in order to avoid injury to the operator. In one embodiment, the apparatus would use a 1/15 horsepower motor which does not have enough force and power to seriously hurt a person's hand in the apparatus as shown. The apparatus takes about fifteen seconds to cycle, however, this cycle could be increased as well as the power and the design of heavy use bar or restaurant can crushing needs. In the present apparatus, if an individual managed to place a portion of his hand into the apparatus and activate the cycle, the individual has a reasonable amount of time to remove the hand from the apparatus before the crushing stroke. The embodiment of the invention as shown in FIG. 1 does not allow the apparatus to operate with the lid open. In addition, for home use, the can crusher would have an elongated rectangular crushing plate 26 of a thickness of about 1/16" made from example, polypropylene which is rigid enough to fold the side of the aluminum can but limber enough not to seriously injure a person's fingers. In addition, the apparatus could also incorporate a relay which would reverse the motor direction at approximately 10% over the force necessary to fold a can. The unit would then open back up and shut off until the foreign object that was restricting the unit motion is cleared and the reset button depressed. The final gap of the can crusher according to the invention closes up to about 3/8" which is about the same as a human finger thus avoiding serious injury to anyone's finger inadvertently placed into the crusher chamber.

The can crusher in accordance with the present invention can be utilized for a low volume restaurant user or for the home user as well as a high volume bar or can drink dispenser booth. Environmental needs as well as raw material recycle economics have placed a substantial demand for collecting aluminum cans. Unfortunately a twenty gallon volume of uncompressed aluminum cans, i.e., a large trash bag filled with cans, weighs only about four to five pounds. The recycle economics pay for these cans on a pound basis. Thus, the recycler, collector, or any user would benefit substantially from the use of a can crusher such as provided in the invention wherein the same twenty gallon volume would weigh from about thirty to forty pounds not only presenting a reasonable storage and handling mode for these cans but also providing the recycler with a pre-crushed volume of higher value. Commercial establishments would benefit substantially because of their volume of cans not only in the physical nature of storage and handling but also in the premium prices received for the crushed cans to the recycle stream. The can crusher in accordance with the invention by collapsing first the side walls and then the ends of the can instead of collapsing the two simultaneously provides for a much more uniformity of can crushing. But more importantly the power or strength requirements by the apparatus according to the invention are reduced because of the mode of crushing; but more importantly those requirements are further reduced by the dual plate motions which are a result of the cooperative cam and slot means for imparting predetermined relational translation motion of the plates which provides plate to plate motion in a unilateral direction and not in opposing directions which can cause frictional or complicated equipment involving greater power use and stronger power drive mechanisms.

The foregoing detailed description is to be clearly understood as given by way of illustration and example only, the spirit and the scope of this invention being limited solely by the appended claims.

What is claimed is:

1. A can crusher for cans formed of aluminum to laterally crush the cans comprising:

a generally T-shaped support structure having a vertical front wall with an elongated rectangular slot formed therethrough above a horizontal portion of the support structure;

an elongated rectangular crushing plate having a crushing plate drive portion carried on the support structure for forward and rearward movement relative thereto through the elongated rectangular slot in the support structure vertical front wall;

a ram plate carried by support arms forwardly of the front wall, said support arms being connected to a drive plate, the ram plate being movable with said drive plate toward and away from the front wall;

a support platform pivotally secured to a lower end of the support structure front wall, the platform defining a crushed can drop space therein;

switch and motor energizing means operated by the support platform;

a can crushing chamber defined by the space within the vertical front wall and ram plate above the support platform and a housing which is mounted to the T-shaped support structure;

said drive plate and said crushing plate drive portion comprising dual drive plates having dual drive cam and dual slot means for moving the dual plates in a predetermined relation translation motion wherein the crushing plate is moved to crush the middle of a can in the crushing chamber and the ram plate is moved to crush the ends of a can in the crushing chamber; and a motor means and gear means drivingly connected to said dual drive cam and dual slot means by a force transfer block for operating said dual drive plates cooperatively drivably for imparting said predetermined relation translation motion of the plates in response to motion of said force transfer block wherein cans can be repetitively crushed in said crushing chamber.

2. The can crusher according to claim 1 wherein the dual drive plates are parallel with overlapping guide slots and common guide rod support means.

3. The can crusher according to claim 1 wherein the dual drive cam and dual slot means provide a eccentrical motion to the dual drive plates upon motion of the drive force transfer block.

4. The can crusher according to claim 3 wherein the eccentrically driven dual drive plates provide changes in horizontal motion speed of the ram plate as the ram plate approaches maximum crush cycle.

5. The can crusher according to claim 4 wherein the ram plate speed is slowed upon approaching maximum crush cycle while power from the motor and gear mean remains constant.

6. The can crusher according to claim 1 wherein the dual drive cam and dual slot means translate the force transfer block circular motion to the dual drive plates substantially to unilateral motion of the plates.

7. The can crusher according to claim 1 wherein the can crushing chamber has a safety lid means pivotally mounted on a vertical can chute above the crushing chamber, the safety lid having a switch means which allow operation of the can crusher when the safety lid means is closed.

8. The can crusher according to claim 7 wherein the can chute and crushing chamber vertically position the can in the chamber.

9. The can crusher according to claim 8 wherein the vertically positioned can in the crushing chamber activates the crushing cycle and the crushing plate through the U-shaped support platform pivot, the crushing plate travel allowing the can to be crushed, along a mid portion in an end-to-end partial fold position.

10. The can crusher according to claim 7 wherein the chute is comprised of an elongated tube means for receiving multiple cans, the chute being mounted at an angle to the axis of the crusher chamber allowing entry of one can per cycle into the crushing chamber.

* * * * *

UNITED STATES PATENT AND TRADEMARK OFFICE

CERTIFICATE OF CORRECTION

PATENT NO. : 5,121,685

DATED : June 16, 1992

INVENTOR(S) : John Turner

It is certified that error appears in the above-identified patent and that said Letters Patent is hereby corrected as shown below:

Column 4, lines 61-62, (Amendment, page 1, lines 11-14) delete "which accommodates entry and withdrawal of the crushing plate 26".

Signed and Sealed this

Thirty-first Day of August, 1993

Bruce Lehman

*Attest:*

BRUCE LEHMAN

*Attesting Officer*

*Commissioner of Patents and Trademarks*